US005083343A

United States Patent [19]

Lee

[11] Patent Number: 5,083,343

[45] Date of Patent: Jan. 28, 1992

[54] HYDRAULICALLY DAMPING APPARATUS FOR DOOR OF CONTROL PART OF ELECTRIC AND ELECTRONIC GOODS

[75] Inventor: Nam-Soo Lee, Seoul, Rep. of Korea

[73] Assignee: SamSung Electronics Co., Ltd., Kyung, Rep. of Korea

[21] Appl. No.: 538,000

[22] Filed: Jun. 14, 1990

[51] Int. Cl.[5] ..... E05F 5/02; E05F 1/00

[52] U.S. Cl. ..... 16/82; 49/379

[58] Field of Search ..... 16/82, 51; 49/379, 386

[56] References Cited

U.S. PATENT DOCUMENTS 2,202,303 5/1940 Swanson ..... 16/82

4,825,503 5/1989 Shiramasa et al. ..... 16/82

*Primary Examiner*—Robert L. Spruill
*Assistant Examiner*—Carmine Cuda
*Attorney, Agent, or Firm*—Robert E. Bushnell

[57] ABSTRACT

A hydraulically damping apparatus for the door of a control part of electric and electronic goods comprises a damper body, a rotating fan having wings mounted on a shaft, a transmitting lever operatively fixed to the shaft of the rotating fan and a door integrally formed with an interlocking plate. The apparatus can shorten the opening time and maintain the safety by automatically controlling the damping oil flow.

7 Claims, 3 Drawing Sheets 8
14
13
1
12
15
6
22b
22c
21
2
22a
51
52
5
23
17
18
11
16
3
31a
31
32
41
9
43
4

HYDRAULICALLY DAMPING APPARATUS FOR DOOR OF CONTROL PART OF ELECTRIC AND ELECTRONIC GOODS

BACKGROUND OF THE INVENTION

This invention relates to a hydraulically damping apparatus, and particularily to a hydraulically damping apparatus for the doors of a control part of electric and electronic goods such as a television or video tape recorder.

Generally, the conventional damping apparatuses for doors can be largely classified into two, types one utilizing gear means, the other utilizing resilient means. The former, as is structured with a gear means, has a constant speed from the beginning till the completion of operation. Therefore, there is a problem that the opening and shutting of the door takes a longer time and the operation is not quick. Utilizing resilient means such as a spring for opening and shutting the door, presents a safety problem for the user as the door carries a high load due to the abrupt opening operation of the door, although it has the merit of quick opening operation by the strong resilient force of the resilient means.

SUMMARY OF THE INVENTION

It is an object of the present invention to provide a hydraulically damping apparatus for the door of a control part of electric and electronic goods, which can shorten the opening time and at the same time, maintain the safety by automatically controlling the oil flow in a hydraulic damper according to the operation of the door so that the door may open quickly in the early opening stage and smoothly in the fully opening stage.

To achieve the above-mentioned object, there is provided a hydraulically damping apparatus for the door of a control part of electric and electronic goods comprising a damper body combined with a cylindrical cap having a shaft hole at the center thereof, and provided with control means being mounted on one side of the damper body for controlling the flow of damping oil; a rotating fan mounted within the damper body and having a shaft extending through the shaft hole; a transmitting lever operatively fixed to a shaft of the rotating fan; a door integrally formed with an interlocking plate which is connected with a slot on one side of the transmitting lever by a pin, the door means being opened and shut resiliently by resilient means.

BRIEF DESCRIPTION OF THE DRAWINGS

These and other objects, features, and advantages of the present invention will become more apparent from the following description for the preferred embodiments taken in conjunction with the accompanying drawings, in which.

DESCRIPTION OF THE PREFERRED EMBODIMENTS

The present invention will now be described in more detail with reference to the accompanying drawings.

Figure 1:
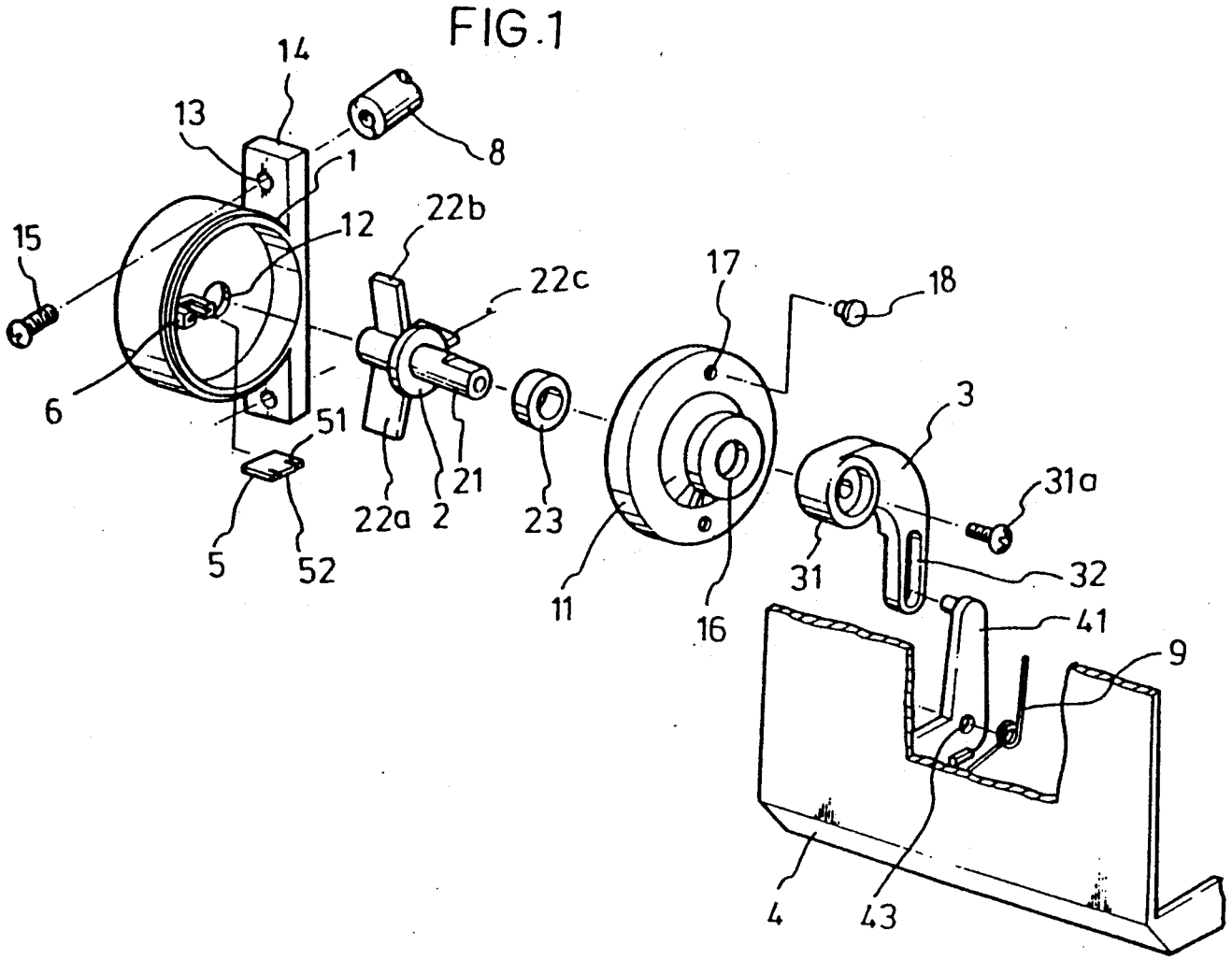
FIG. 1 is an enlarged perspective view of an embodiment according to the present invention.
Figure 2:
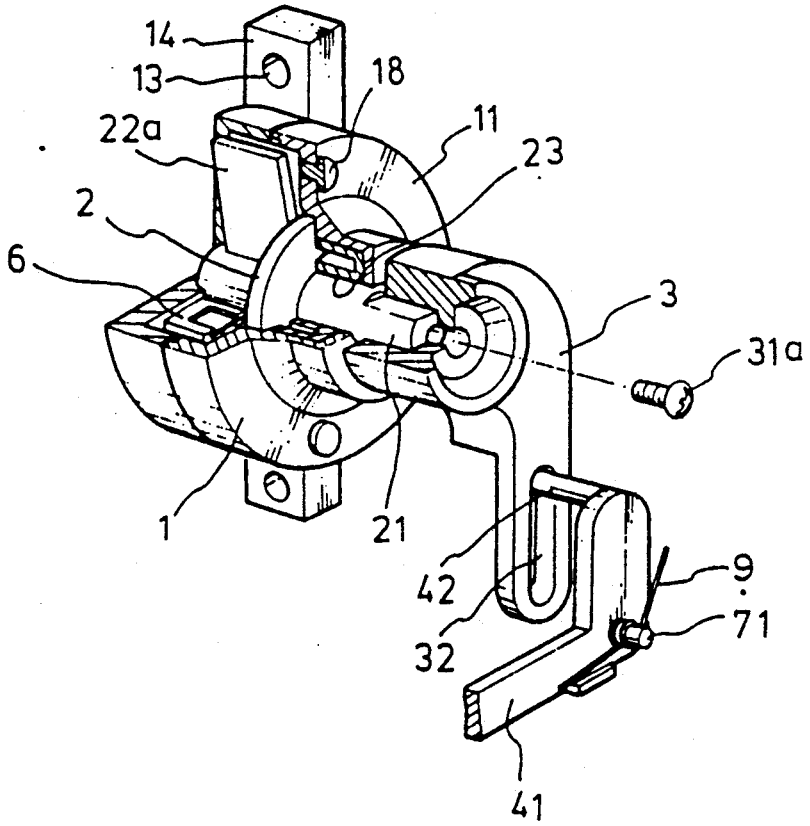
FIG. 2 is a partially cutaway perspective view illustrating the assembled state of the embodiment according to the present invention.
Figure 5A:
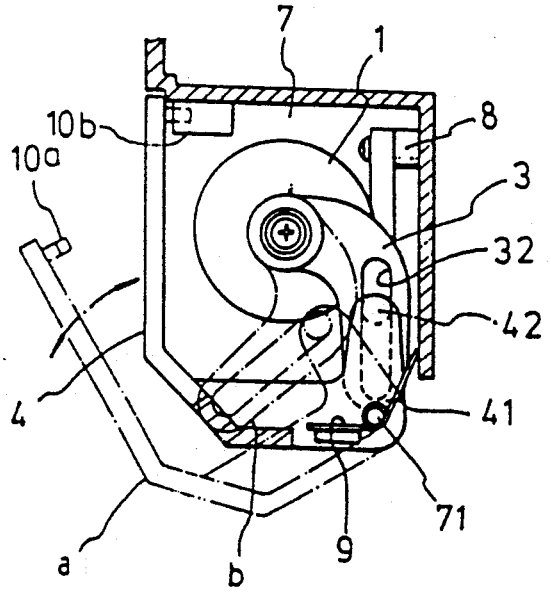
FIGS. 5(A) and (B) are side views illustrating the operating and shutting states of the door of the embodiment according to the present invention.

FIG. 1 is an enlarged perspective view of the hydraulically damping apparatus for a door of the present invention. A cylindrical cap 11 is coupled to the front side of a cylindrical damper body 1. A rotating fan 2 for damping oil is mounted within the damper body 1 and the cap 11. A transmitting lever 3 is interlockingly fixed to a shaft 21 of the rotating fan 2. A door 4 for opening and shutting rotationally from a control part 7, FIG. 5A, is interlocked with the arm of the transmitting lever 3. A shaft groove 12 is formed on the center of an inner surface of the damper body 1 so that the rear end of the shaft 21 of the rotating fan 2 may be mounted. A supporting member 6 is mounted on a side of the damper body 1 for the insertion of a braking plate 5 which controls the flow of damping oil. A fixing bar 14 is integrally formed on a side of the outer circumferential surface of the damper body 1 to fix the body 1 to a boss 8 protruding from the inner surface of the control part 7 with a screw 15 as shown in FIG. 5. Furthermore, the cylindrical cap 11 coupled with the damper body 1 has a shaft hole 16 on the center so that the front end of the shaft 21 of the rotating fan 2 may be exposed through the shaft hole 16. The shaft 21 is fixed to a fixing part of the transmitting lever 3 with a screw 31*a*. Oil injection holes 17 are formed on the upper and lower side of the cylindrical cap 11 and are sealed with plugs 18.

Figure 3:
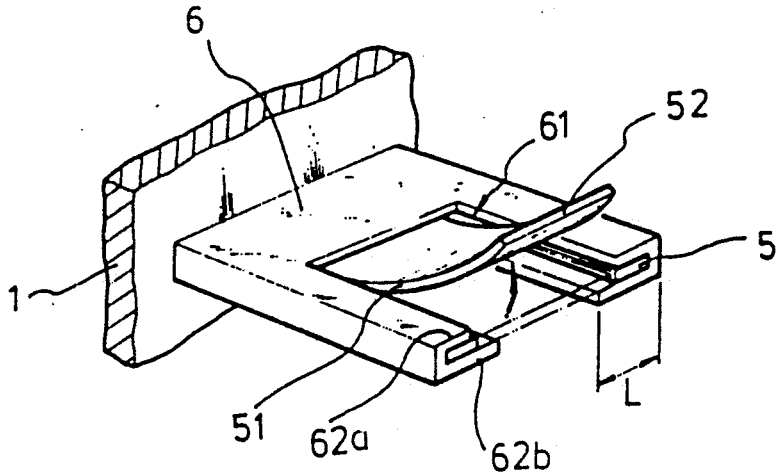
FIG. 3 is a perspective view illustrating damping oil braking means of the embodiment according to the present invention.

Meanwhile, as shown in FIG. 3, a braking member 52 is formed on the middle of the front end of the braking plate 5 by sectioned parts 51 on both sides. The supporting member 6 inside of the damper body 1 has a recess 61 and upper and lower supporting segments 62*a* and 62*b* on both sides. The lower supporting segment 62*b* is longer than the upper supporting segment 62*a* in length L so that the braking member 52 of the braking plate 5 which is inserted into the recess 61, can be bent upward but not downward because of the support by both the sides of the lower supporting segment 62*b*.

Figure 4A:
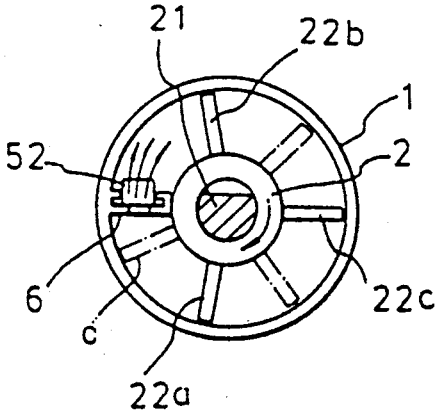
FIGS. 4(A) and (B) are side views illustrating the operating state of a rotating fan of the embodiment according to the present invention.
Figure 4B:
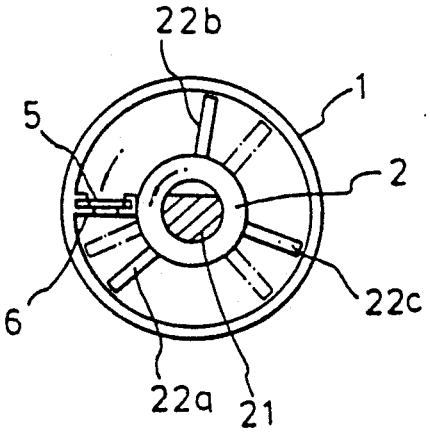

Furthermore, blades or wings 22*a*, 22*b*, 22*c* as better illustrated in FIGS. 4A and 4B of the damping oil rotating fan 2 are arranged so that the angle between wings 22*a* and 22*b* is wider than that between the others. A packing ring 23 made of, for example, rubber, is placed on the front end of the shaft 21 to prevent the oil from leaking through the shaft hole 16 of the cylindrical cap 11. The transmitting lever 3 has a slide slot 32 on its arm. An interlocking pin 42 which protrudes on the upper part of an interlocking plate 41 of the door is inserted through the slot 32. A hinge hole 43 is formed on the center of the interlocking plate 41. As shown in FIG. 5, a hinge pin 71 protruding from a sidewall of the control part 7 is inserted into the hole 43 for assembly. A coil spring 9 is placed around the hinge pin 71 so that the door 4 may be set up resiliently on the control part 7 to be opened by the restoring force of the spring 9.

Furthermore, as shown in FIG. 5(A), the upper end of the door 4 has an extruding locking segment 10*a*. A locker 10*b* is formed on the position in correspondence to the locking segment 10*a* in the upper inside of the control part, so that the locking segment 10*a* and the locker 10*b* can be coupled together.

The operation of the present invention with the above structure will be now 6c explained. At the solid line position in FIG. 5(A), the locking member 10a in the locked state is released from the locker 10b of the control part 7 by the upper part of the door 4 being pushed in a conventional manner. The door 4 is pushed open by the restoring force of the coil spring 9 mounted resiliently on the lower part of the door 4.

With the door 4 open as shown with the alternate long and short dash line, the interlocking pin 42 extruded on the upper part of the interlocking plate 41, starts rotating, centering around the hinge pin 71 in a counterclockwise direction while interlocking with the slide slot 32. Therefore, the transmitting lever 3 rotates in a clockwise direction as shown with the alternate long and short dash line b. Through the shaft 21 of the rotating fan 2 fixed with the upper fixing part 31 of the lever 3, the rotating fan 2 mounted inside of the damper body 1, as shown in FIG. 4(A), simultaneously rotates in a clockwise direction so that the wings 22a, 22b, 22c move to the position shown with the alternate long and short line c.

As the wings 22a, 22b, 22c rotate as described above, the damping oil between the wings 22a and 22b is pushed to move. The breaking plate 5 which is inserted into the supporting member 6 is positioned between these wings. The braking plate 5 has the braking member 52 in the middle of the front end with the sectioned parts 51 on both sides. The braking member 52 is not supported upward because of the wider distance between the upper supporting segments 62a both sides of the recess 61 formed on the supporting member 6. Therefore, the braking member 52 is bent upward by the pressure of the damping oil being moved clockwise as shown in FIG. 3 and FIG. 4(A). As the oil passage way by the inserting part 61 is widely opened, the damping oil can pass through the braking plate 5 rapidly.

Further, as the wings 22a, 22b, 22c of the rotating fan 2 rotate with less friction force from the damping oil, the door 4 opens quickly. At the same time, the interlocking pin 42 slides upward along the slide slot 32 formed on the lever 3. As the interlocking pin 42 reaches the upper end of the slide slot 32, the pin 42 can not move upward anymore. Therefore, the rotating inertia of the door is transmitted reversely to the transmitting lever 3 through the interlocking pin 42.

Figure 5B:
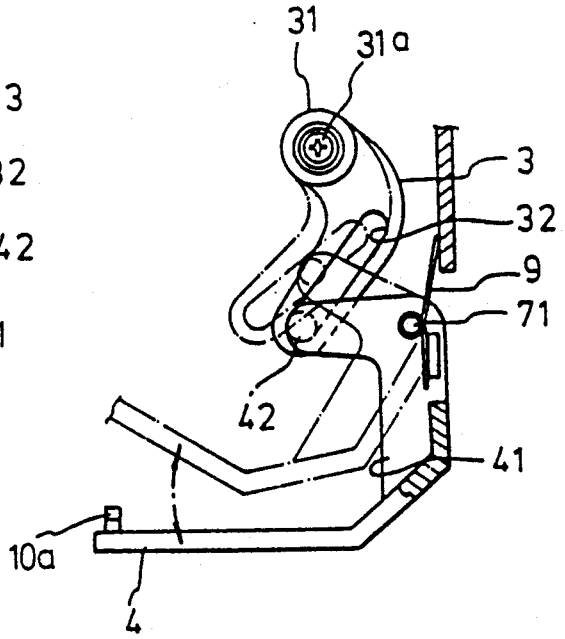

As shown in FIG. 5(B), the lever 3 rotates in a counterclockwise direction. The rotating fan 2 also rotates in a counterclockwise direction by the shaft 21, as shown in FIG. 4(B), and the damping oil between the wings 22a, 22b moves in a counterclockwise direction. The braking member 52 moves downward by the pressure from the flowing damping oil. The braking member 52, however, can not be bent downward because of the narrow distance between the lower supporting segments 62b. As the braking member 52 is held horizontal, the oil passage way formed by the inserting part 61 is closed and the resisting force of the damping oil is transmitted to the wings 22a, 22b of the rotating fan 2. Therefore, the wings 22a, 22b, 22c receive the resistance from the damping oil and the rotation of the rotating fan 2 slows down. From this moment, the door 4 rotates open slowly and smoothly until it is fully open.

Furthermore, in case of closing the door the door is lifted upward and pushed manually in the conventional manner and the door is closed with all the mechanism following the reverse order of the opening.

As mentioned above, with the controlling means mounted inside the damper body and by controlling the flow of the damping oil through the braking plate of the controlling means, the door opens rapidly in the early stage and, after it is opened to a certain amount, slowly and smoothly until it is fully opened. Therefore the present invention shortens the total opening time and increases the safety of the user in opening and closing the door so that it helps increase the reliability and quality of the product.

The invention is in no way limited to the embodiment described hereinabove. Various modifications of the disclosed embodiment as well as other embodiments of the invention will become apparent to persons skilled in the art upon reference to the description of the invention. It is therefore contemplated that the appended claims will cover any such modifications or embodiments as fall within the true scope of the invention.

What is claimed is:

1. A hydraulically damping apparatus for a door of a control panel of an electric or electronic device, comprising:

a damper body combined with a cap to form a hydraulic chamber, the cap having a shaft hole at the center thereof;

flow control means mounted on one side of said damper body within said chamber for controlling the flow of damping oil;

a fan rotatably mounted within said damper body and having a shaft extending through the shaft hole;

a transmitting lever operatively fixed to a shaft of said rotating fan;

a door connected with one side of said transmitting lever for rotating said fan during movement of said door;

resilient means for respectively applying to said door a restoring force for opening said door and a resistive force when closing said door.

2. An apparatus as claimed in claim 1, wherein said flow control means comprises:

a supporting member provided on the inner surface of said damper body; and a braking plate having a braking member formed at a first end thereof, said supporting member having a recess in which a second end of said braking plate is inserted and upper and lower supporting segments, said lower segment having lip means for supporting said braking plate while said upper segment allowing free travel of said braking plate.

3. A hydraulic damping apparatus for a door, comprising:

a chamber for containing hydraulic fluid, fluid moving means extending into said chamber for selectively driving said fluid in first and second flow directions;

connecting means having first and second connecting members for connecting said door to said fluid moving mean;

a coil spring connected to one of said first or second connecting members of said connecting means for applying a restoring force to said one of said first or second connecting members for opening said door; and fluid damping means mounted in said chamber for controlling the flow of oil through said chamber and for providing greater flow resistance in said second flow direction, wherein said fluid damping means comprises:

a resilient member positioned in the path of fluid flow and supported by a supporting means mounted to a wall of said chamber which allows for deformation of said resilient member in said first flow direction to allow passage of fluid in said first flow direction and which prevents deformation of said resilient member in said second flow direction to impede the passage of fluid flowing in said second flow direction.

4. A hydraulic damping apparatus according to claim 3, wherein:

said first connecting member is attached to said fluid moving means, said second connecting member is attached to said door, and further comprising:

linking means connecting said first and second connecting members for driving said first connecting member in a first direction during a first portion of the travel of said second connecting member in a second direction and for driving said first connecting member in the second direction during a second portion of travel of said second connecting member in said second direction, wherein:

said fluid moving means drives said fluid in said first flow direction during movement of said first connecting member in said first direction and in said second flow direction during movement of said first connecting member in said second direction.

5. A hydraulic damping apparatus according to claim 4, wherein:

said linking means includes a slot formed in one of said connecting members and a corresponding pin formed in the other connecting member; and said first and second connecting members are pivotally mounted on parallel offset axes.

6. The hydraulic damping apparatus as claimed in claim 3, wherein said resilient member comprises a braking plate which is bendable in said first flow direction, and wherein said resilient member is prevented from bending in said second flow direction by said supporting means.

7. A hydraulically damping apparatus for a door, comprising:

a damper body combined with a cap to form a hydraulic chamber, the cap having a shaft hole at the center thereof;

flow control means mounted on one side of said damper body within said chamber for controlling the flow of damping oil;

said flow control means including:

a supporting member provided on the inner surface of said damper body; and a braking plate having a braking member formed at a first end thereof, said supporting member having a recess in which a second end of said braking plate is inserted and supporting segments, said supporting segments having lip means for supporting said braking plate;

a fan rotatably mounted within said damper body and having a shaft extending through the shaft hole;

a transmitting lever operatively fixed to a shaft of said rotating fan;

a door connected with one side of said transmitting lever for rotating said fan during movement of said door; and resilient means for respectively applying to said door a restoring force for opening said door and a resistive force when closing said door.

* * * * *

UNITED STATES PATENT AND TRADEMARK OFFICE

CERTIFICATE OF CORRECTION

PATENT NO. : 5,083,343

DATED : 28 January 1992

INVENTOR(S) : Nam-Soo LEE

It is certified that error appears in the above-identified patent and that said Letters Patent is hereby corrected as shown below:

Column 3, Line 2, delete "be", and replace "6c" with--be--;

Line 31, insert --on-- after "62a";

Signed and Sealed this

Eighteenth Day of May, 1993

*Attest:*

Michael K. Kirk

MICHAEL K. KIRK

*Attesting Officer*

*Acting Commissioner of Patents and Trademarks*